US009711134B2

(12) United States Patent
Kuwahara et al.

(10) Patent No.: US 9,711,134 B2
(45) Date of Patent: Jul. 18, 2017

(54) AUDIO INTERFACE

(75) Inventors: Noriaki Kuwahara, Katsuragi-gun (JP); Tsutomu Miyasato, Nara (JP); Yasuyuki Sumi, Nara (JP)

(73) Assignee: EMPIRE TECHNOLOGY DEVELOPMENT LLC, Wilmington, DE (US)

( * ) Notice: Subject to any disclaimer, the term of this patent is extended or adjusted under 35 U.S.C. 154(b) by 768 days.

(21) Appl. No.: 13/522,299

(22) PCT Filed: Nov. 21, 2011

(86) PCT No.: PCT/US2011/061704

§ 371 (c)(1),
(2), (4) Date: Jul. 13, 2012

(87) PCT Pub. No.: WO2013/077843

PCT Pub. Date: May 30, 2013

(65) Prior Publication Data

US 2013/0132087 A1 May 23, 2013

(51) Int. Cl.
*G10L 13/00* (2006.01)
*G10L 13/033* (2013.01)
(Continued)

(52) U.S. Cl.
CPC ..... *G10L 13/033* (2013.01); *H04S 7/304* (2013.01); *G10L 13/047* (2013.01); *G10L 21/003* (2013.01); *H04R 1/1041* (2013.01); *H04R 5/033* (2013.01)

(58) Field of Classification Search
CPC ..... G10L 13/033; G10L 13/08; G10L 13/00; G10L 13/02; G10L 13/04;
(Continued)

(56) References Cited

U.S. PATENT DOCUMENTS 5,521,981 A * 5/1996 Gehring ..... H04S 1/002 381/17
6,121,532 A * 9/2000 Kay ..... G10H 1/00 84/445
(Continued)

FOREIGN PATENT DOCUMENTS

JP 2010122369 A 6/2010

OTHER PUBLICATIONS

Toda, T., et al., One-to-many and many-to-one voice conversion based on Eigenvoices, Proceedings of IEEE International Conference on Acoustics, Speech and Signal Processing, Apr. 2007, pp. 1249-1252, Hawaii, USA.
(Continued)

*Primary Examiner* — Abdelali Serrou
(74) *Attorney, Agent, or Firm* — Amin, Turocy & Watson, LLP

(57) ABSTRACT

Methods, systems, and apparatus are generally described for providing an audio interface. In some examples, first voice data of a first narrator and a second voice data of a second narrator are received and the second voice data is transformed by a voice transformation function. At least a part of a first text data is converted into a first synthesized voice data based, at least in part, on the first voice data and at least a part of a second text data is converted into a second synthesized voice data based, at least in part, on the transformed second voice data by applying a voice transformation function which maximizes a feature difference between the first voice data and the transformed second voice data. The first synthesized voice data and the second synthesized voice data are provided in parallel on a temporal axis via the voice interface system.

21 Claims, 7 Drawing Sheets

(51) Int. Cl.

| | |
|---|---|
| ***H04S 7/00*** | (2006.01) |
| *G10L 21/003* | (2013.01) |
| *G10L 13/047* | (2013.01) |
| *H04R 1/10* | (2006.01) |
| *H04R 5/033* | (2006.01) |

(58) Field of Classification Search

CPC ..... G10L 2021/0135; G10L 13/047; G10L 15/22; G06F 3/0482

USPC ..... 704/260, 258, E13.008, E13.004, 704/E13.011, 270.1, E13.001, E15.001, 704/231, 235, 254, 257, 266

See application file for complete search history.

(56) References Cited

U.S. PATENT DOCUMENTS

| | | | | |
|---|---|---|---|---|
| 6,336,092 | B1 * | 1/2002 | Gibson | G10H 1/366 704/207 |
| 7,277,855 | B1 * | 10/2007 | Acker et al. | 704/260 |
| 7,571,099 | B2 * | 8/2009 | Saito et al. | 704/268 |
| 7,844,215 | B2 | 11/2010 | Vance et al. | |
| 8,472,653 | B2 * | 6/2013 | Kon | H04S 1/002 381/17 |
| 2002/0049594 | A1 * | 4/2002 | Moore et al. | 704/258 |
| 2002/0072906 | A1 * | 6/2002 | Koh | 704/260 |
| 2002/0152877 | A1 * | 10/2002 | Kay | G10H 1/00 84/609 |
| 2003/0023440 | A1 | 1/2003 | Chu | |
| 2004/0019484 | A1 * | 1/2004 | Kobayashi et al. | 704/258 |
| 2004/0019485 | A1 * | 1/2004 | Kobayashi et al. | 704/260 |
| 2005/0137862 | A1 * | 6/2005 | Monkowski | 704/222 |
| 2006/0069567 | A1 * | 3/2006 | Tischer et al. | 704/260 |
| 2006/0074672 | A1 * | 4/2006 | Allefs | G10L 13/033 704/258 |
| 2006/0095265 | A1 * | 5/2006 | Chu | G10L 13/033 704/268 |
| 2006/0247919 | A1 | 11/2006 | Specht et al. | |
| 2007/0208566 | A1 * | 9/2007 | En-Najjary et al. | 704/269 |
| 2008/0235024 | A1 * | 9/2008 | Goldberg et al. | 704/260 |
| 2009/0006096 | A1 * | 1/2009 | Li et al. | 704/260 |
| 2009/0037179 | A1 * | 2/2009 | Liu et al. | 704/260 |
| 2009/0063156 | A1 * | 3/2009 | Squedin et al. | 704/261 |
| 2009/0150151 | A1 * | 6/2009 | Sakuraba | G10L 21/028 704/246 |
| 2010/0082334 | A1 | 4/2010 | Schultz | |
| 2010/0299148 | A1 | 11/2010 | Krause et al. | |
| 2011/0182283 | A1 | 7/2011 | Van Buren et al. | |
| 2012/0239387 | A1 * | 9/2012 | Ben-David et al. | 704/203 |
| 2013/0151256 | A1 * | 6/2013 | Nakano et al. | 704/268 |

OTHER PUBLICATIONS

Wikipedia, Simulated annealing,last modified on Jun. 28, 2012, accessed online on Jul. 13, 2012 via http://en.wikipedia.org/wiki/Simulated_annealing.

Zen, H. et al., Recent developments of the HMM-based speech synthesis system (HTS), Institute of Electronics, Information and Communication Engineers Technical Report, Speech (SP), Dec. 13, 2007, vol. 107, No. 406, pp. 301-306.

United States Patent and Trademark Office, International Search Report and Written Opinion of the International Searching Authority for PCT/US2011/061704, mailed on Apr. 24, 2012, USA.

Di, M., Quantitative measurement of voice separation ability on auditory cognition and its application to higher brain function enhancement, Kochi University of Technology, 2008, accessed online on Jul. 13, 2012 via http://kutarr.lib.kochi-tech.ac.jp/dspace/bitstream/10173/509/1/1096409509.pdf, Kochi, Japan.

"GalateaTalk Japanese text-to-speech synthesis software (GalateaTalk)," accessed at http://www.nilab.info/wiki/GalateaTalk.html, accessed on Dec. 2, 2014, pp. 1-3.

Kingston, J.L., "Separation of Simultaneous Word Sequences Using Markov Model Techniques," Master's thesis, Naval Postgraduate School, U.S., pp. 1-63 (Sep. 1990).

Ogura, K., et al., "Exploration of Possibility of Multithreaded Conversations Using a Voice Communication System," Ed. By Jacko, J., Human-Computer Interaction, HCI Intelligent Multimodal Interaction Environments, Lecture Notes in Computer Science, vol. 4552, pp. 186-195 (2007).

Goose, S., and Möller, C., "A 3D Audio only Interactive Web Browser: Using Spatialization to Convey Hypermedia Document Structure," Multimedia '99 Proceedings of the seventh ACM international conference on Multimedia (Part 1), pp. 363-371 (Oct. 30, 1999).

Kobayashi, M., and Schmandt, C., "Dynamic Soundscape: mapping time to space for audio browsing," Proceedings of the ACM SIGCHI Conference on Human factors in computing systems, pp. 194-201 (Mar. 27, 1997).

Sato, D., and Zhu, S. et al., "Sasayaki: voice augmented web browsing experience," Proceedings of the SIGCHI conference on Human Factors in Computing Systems, pp. 2769-2778 (May 7, 2011).

Schmandt, C., and Mullins, A., "AudioStreamer: Exploiting Simultaneity for Listening," CHI '95 Conference Companion on Human Factors in Computing Systems, pp. 218-219 (May 7-11, 1995).

European Search Report with Opinion for EP Application 11876267.3 mailed on May 4, 2016, 6 pages.

* cited by examiner (A)

(B)

AUDIO INTERFACE

CROSS-REFERENCE TO RELATED APPLICATION

The present application is a U.S. national stage filing under 35 U.S.C. §371 of International Application No. PCT/US2011/061704, filed on Nov. 21, 2011, which is incorporated herein by reference in its entirety.

BACKGROUND

Audio interfaces may make human interaction with machines possible through a voice/speech platform in order to initiate an automated service or process. Voice interfaces have become more commonplace, and people are taking advantage of the value that these hands free and eyes free interfaces provide in many situations. Compared with visual interfaces, however, voice interfaces have the restriction that it is generally difficult to present multiple items of spoken information at the same time. Automated voice answering systems for phones are a typical example. A conceivable approach for improving the efficiency of a voice interface is to substantially simultaneously present multiple items of spoken information to a user. With this approach, however, one item of spoken information is masked by another item of spoken information due to psychoacoustic effects, which make it difficult for the user to recognize what is spoken.

SUMMARY

In an example, a method in an audio interface system may include receiving a first voice data of a first narrator and a second voice data of a second narrator, transforming the second voice data by a voice transformation function, receiving a first text data and a second text data, converting at least a part of the first text data into a first synthesized voice data based, at least in part, on the first voice data, converting at least a part of the second text data into a second synthesized voice data based, at least in part, on the transformed second voice data and providing the first synthesized voice data and the second synthesized voice data via the voice interface system.

In an example, a method in an audio interface system may include receiving a first text data and a second text data from an outside network, converting at least a part of the first text data into a first synthesized voice data based, at least in part, on a first voice data, converting at least a part of the second text data into a second synthesized voice data based, at least in part, on a transformed second voice data that is transformed from a second voice data by a voice transformation function and providing the first synthesized voice data and the second synthesized voice data via the voice interface system.

In an example, an audio interface system may include a database configured to store at least one acoustic model of a first voice data and at least one acoustic model of a transformed second voice data that is transformed from a second voice data by a voice transformation function, a converting unit configured to convert at least a part of a first text data into a first synthesized voice data based, at least in part, on the at least one acoustic model of the first voice data and configured to convert at least a part of a second text data into a second synthesized voice data based, at least in part, on the at least one acoustic model of the transformed second voice data and a play-back unit configured to play the first synthesized voice data and the second synthesized voice data.

In an example, a computer-readable storage medium having stored thereon computer-executable instructions that, in response to execution, cause a voice interface system to perform operations including receiving a first voice data of a first narrator and a second voice data of a second narrator, transforming the second voice data by a voice transformation function, receiving a first text data and a second text data, converting at least a part of the first text data into a first synthesized voice data based, at least in part, on the first voice data, converting at least a part of the second text data into a second synthesized voice data based, at least in part, on the transformed second voice data and providing the first synthesized voice data and the second synthesized voice data via the voice interface system.

In an example, a computer-readable storage medium having stored thereon computer-executable instructions that, in response to execution, cause a voice interface system to perform operations including receiving a first text data and a second text data from an outside network, converting at least a part of the first text data into a first synthesized voice data based, at least in part, on a first voice data, converting at least a part of the second text data into a second synthesized voice data based, at least in part, on a transformed second voice data that is transformed from a second voice data by a voice transformation function and providing the first synthesized voice data and the second synthesized voice data via the voice interface system.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The foregoing and other features of this disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings, in which:

Figure 1:
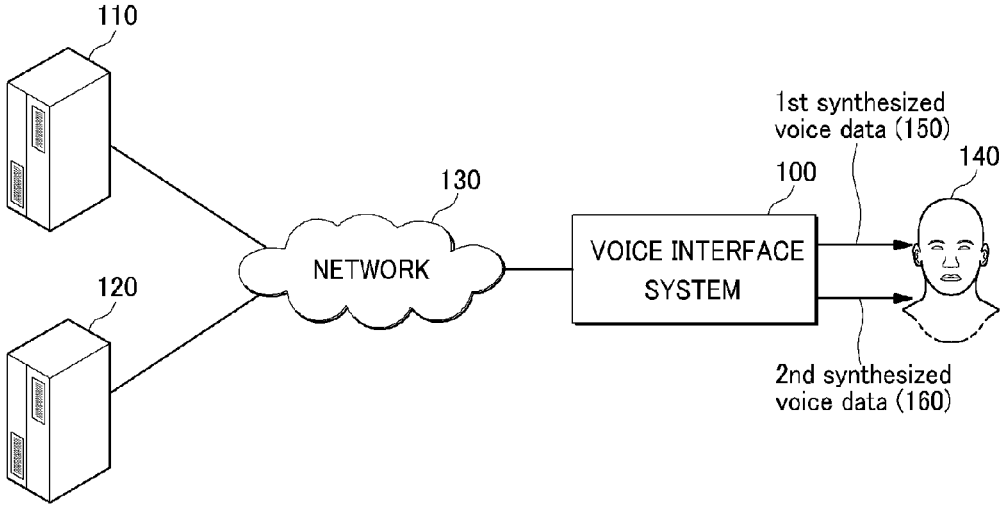
FIG. 1 schematically shows an illustrative example of a network system where a voice interface system provides a user with a multiple number of voice data based on a multiple number of text data from a multiple number of servers via an outside network.

all arranged in accordance with at least some embodiments described herein.

DETAILED DESCRIPTION

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

This disclosure is generally drawn, inter alia, to methods, apparatus, systems, devices, and computer program products related to voice interfaces.

Briefly stated, technologies are generally described for a voice interface system configured to provide a user of the voice interface system with multiple items of spoken information (which are readily distinguishable from each other) at the same time. In some examples, the voice interface system may receive via an outside network a multiple number of text data, each of which may be transmitted from respective servers. By way of example, but not limitation, the servers may include an e-mail server, a web server and a social networking service (SNS) server, and the text data may include an e-mail message, a web page and an SNS message. The voice interface system may convert at least a part of the respective text data (e.g., an e-mail header, really simple syndication (RSS) feed information, and a sender of an SNS message) into synthesized voice data using different acoustic models stored in a database of the voice interface system.

In some example, the database may store a multiple number of acoustic models of a multiple number of voice data. By way of example, but not limitation, the database may store at least one acoustic model of a first voice data and at least one acoustic model of a transformed second voice data. The transformed second voice data is transformed from a second voice data by a voice transformation function that maximizes a feature difference between the first voice data and the transformed second voice data.

In some embodiments, the voice interface system may convert a first text data and a second text data into a first synthesized voice data and a second synthesized voice data based on the at least one acoustic model of the first voice data and the at least one acoustic model of the transformed second voice data, respectively, and present the first and second synthesized voice data to a user of the voice interface system. Since the feature difference between the first voice data and the transformed second voice data may have been maximized by the voice transformation function, the first synthesized voice data and the second synthesized voice data can be readily distinguished from each other even when presented substantially simultaneously to the user of the voice interface system.

FIG. 1 schematically shows an illustrative example of a network system where a voice interface system provides a user with a multiple number of voice data based on a multiple number of text data from a multiple number of servers via an outside network in accordance with at least some embodiments described herein. As depicted in FIG. 1, a voice interface system 100 may receive a first text data from a first server 110 and a second text data from a second server 120 via an outside network 130. By way of example, but not limitation, each of first server 110 and second server 120 may include an e-mail server that provides an e-mail message, a web server that provides a web page and an SNS server that provides an SNS message. Although FIG. 1 illustrates that voice interface system 100 receives text data from two servers (first server 110 and second server 120), it is noted that voice interface system 100 may further receive via outside network 130 other text data from one or more other servers. In some embodiments, voice interface system 100 may receive text data from one or more electronic devices which are connected to voice interface system 100 in a direct connection or via an internal network.

Voice interface system 100 may convert the received first and second text data into synthesized voice data and provide the synthesized voice data to a user 140 of voice interface system 100. In some embodiments, voice interface system 100 may convert at least a part of the first text data and at least a part of the second text data into a first synthesized voice data 150 and a second synthesized voice data 160, respectively, by referring to a database (not shown) of voice interface system 100. The database will be described more in detail with reference to FIG. 2 below. Voice interface system 100 may then provide user 140 of voice interface system 100 with first synthesized voice data 150 and second synthesized voice data 160 at the same time.

Figure 3:
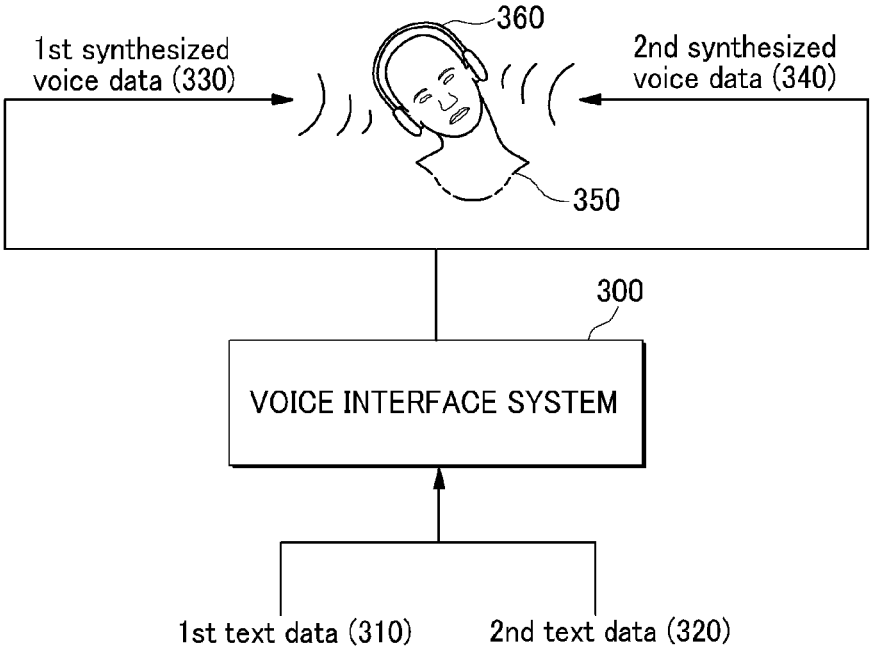
FIG. 3(A) schematically shows an illustrative example of a voice interface system configured to provide two voice data substantially simultaneously to a user.
FIG. 3(B) schematically shows an illustrative example of a voice interface system configured to provide additional data in response to a user selection.
Figure 3:
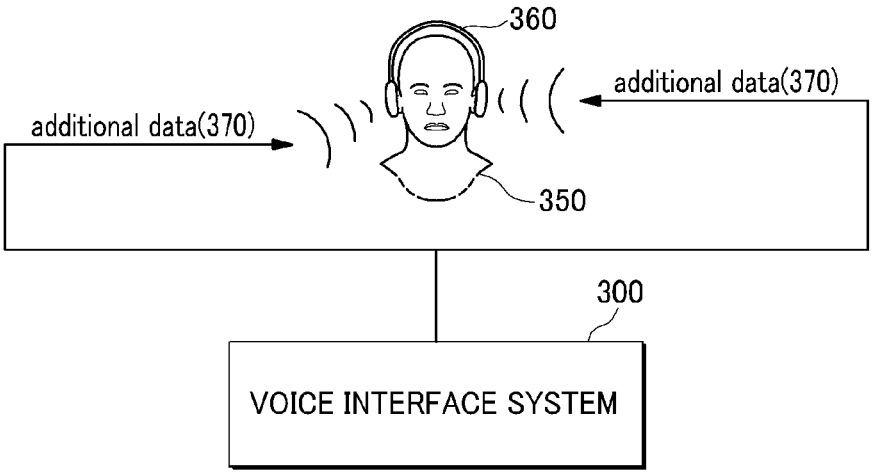

In some embodiments, user 140 of voice interface system 100 may select one of first synthesized voice data 150 or second synthesized voice data 160 by showing an indication of a selection, which will be described more in detail with reference FIG. 3 below. Voice interface system 100 may receive the indication of the selection of one of first synthesized voice data 150 or second synthesized voice data 160, and provide additional data corresponding to the selected one to user 140 of voice interface system 100.

Figure 2:
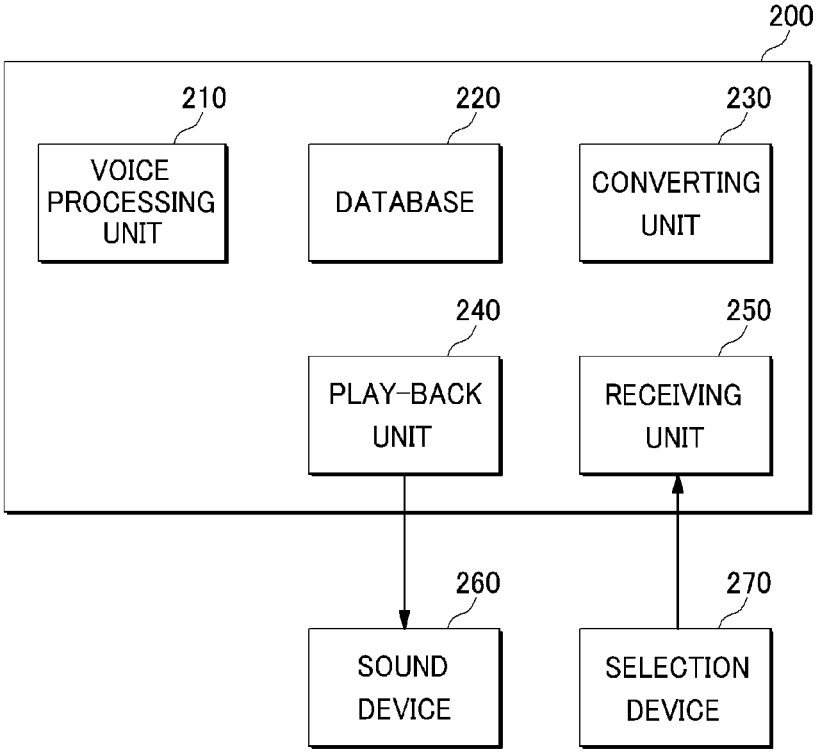
FIG. 2 shows a schematic block diagram illustrating an example of components for voice interface system.

FIG. 2 shows a schematic block diagram illustrating an example of components for voice interface system in accordance with at least some embodiments described herein. A voice interface system 200 may include a voice processing unit 210, a database 220, a converting unit 230, a play-back unit 240 and a receiving unit 250. Although illustrated as discrete components, various components may be divided into additional components, combined into fewer components, or eliminated, depending on the desired implementation.

Voice processing unit 210 may be configured to generate an acoustic model based on a voice data and store the acoustic model in database 220. In some embodiments, voice processing unit 210 may receive a first voice data of a first narrator and a second voice data of a second narrator. Voice processing unit 210 may then determine a voice transformation function that maximizes a feature difference between the first voice data of the first narrator and the second voice data of the second narrator. The feature difference may be a difference in power spectrum between two voices in consideration of masking effects in a frequency domain and the minimum audible level in a quiet environment. In some embodiments, voice processing unit 210 may transform the second voice data of the second narrator with the voice transformation function and extract at least one acoustic model of the transformed second voice data. As for the first voice data of the first narrator, voice processing unit 210 may extract at least one acoustic model from the original voice data. These acoustic models of the first voice data and the transformed second voice data may be stored in database 220.

In some embodiments, if the first and second voice data are in the Japanese language, voice processing unit 210 may determine the voice transformation function based on the Japanese vowel sounds (i.e., "a," "i," "u," "e," and "o"). This may be because the consonants commonly appear with the vowels in the Japanese language, and thus, the frequency of occurrence of the vowel sounds may be relatively high. The waveforms of the vowel sounds in the frequency domain may be temporally stable as well. By way of example, but not limitation, voice processing unit 210 may determine the voice transformation function in the following manner. First, let a sound i in the first voice data of the first narrator be expressed by F_i(f) in the frequency domain, and its masking effect by Mask_i(f). Further, let the minimum audible level in a quiet environment be expressed by HT(f). Lastly, let a sound j in the second voice data of the second narrator be expressed by G_j(f). Then, the difference between the sound i in the first voice data at a frequency f and a sound obtained by transforming the sound j in the second voice data at the frequency f by a voice transformation function Trans may be obtained from Equation 1 below. Integrating the difference for all the frequency components and taking the sum of the results of integration for all i and j may yield a feature difference between the first voice data and the second voice data, as expressed in Equation 2 below. The voice transformation function Trans, which may maximize the feature difference may be used to transform the second voice data of the second narrator.

$$\text{Diff_ij}(Trans, f) = \begin{cases} |\text{F_i}(f) - Trans(\text{G_j}(f))| \ldots \\ \ldots \text{ if } (Trans(\text{G_j}(f)) > \max\{\text{Mask_i}(f), HT(f)\}) \\ 0 \ \ldots \text{ otherwise} \end{cases} \quad \text{[Equation 1]}$$

$$Diff(Trans) = \sum_{i,j} \int \text{Diff_ij}(Trans, f)df \quad \text{[Equation 2]}$$

In some embodiments, having determined the voice transformation function that maximizes the feature difference, voice processing unit 210 may extract at least one acoustic model of the second voice data of the second narrator in the following manner. First, voice processing unit 210 may receive a second voice data of phonetically balanced sentences read aloud by the second narrator. Voice processing unit 210 may then transform the second voice data of phonetically balanced sentences with the voice transformation function that maximizes the feature difference. Voice processing unit 210 may analyze and learn speech spectra, excitation sources, and/or durations of the transformed second voice data of phonetically balanced sentences to extract at least one acoustic model of the transformed second voice data. Although FIG. 2 illustrates voice processing unit 210 as a part of voice interface system 200, one skilled in the art will appreciate that voice processing unit 210 may be a separate unit from voice interface system 200.

Converting unit 230 may be configured to convert text data into synthesized voice data based, at least in part, on at least one acoustic model stored in database 220. In some embodiments, converting unit 230 may receive text data from an outside server via an outside network. By way of example, but not limitation, converting unit 230 may receive a first text data of an e-mail message from an e-mail server and a second text data of a web page from a web server via an outside network. Converting unit 230 may convert at least a part of the first text data into a first synthesized voice data based, at least in part, on the at least one acoustic model of the first voice data of the first narrator. Also, converting unit 230 may convert at least a part of the second text data into a second synthesized voice data based, at least in part, on the at least one acoustic model of the transformed second voice data of the second narrator. Since the feature difference between the first voice data and the transformed second voice data is maximized by the voice transformation function as discussed above, the first synthesized voice data and the second synthesized voice data may be readily distinguished from each other even when presented substantially simultaneously.

In some embodiments, converting unit 230 may include a speech synthesis module in order to convert text data into synthesized voice data. The speech synthesis module may include animated human type interface such as, but not limited to, Galatea Talk. By way of example, but not limitation, converting unit 230 may incorporate the at least one acoustic model of the first voice data into the speech synthesis module, and based, at least in part, on that, convert the at least a part of the first text data into the first synthesized voice data. Similarly, converting unit 230 may incorporate the at least one acoustic model of the transformed second voice data into the speech synthesis module, and based, at least in part, on that, convert the at least a part of the second text data into the second synthesized voice data.

Play-back unit 240 may be configured to play the first synthesized voice data and the second synthesized voice data. In some embodiments, play-back unit 240 may play the first synthesized voice data and the second synthesized voice data and present via a sound device 260 the first synthesized voice data and the second synthesized voice data substantially simultaneously to a user of voice interface system 200.

Receiving unit 250 may be configured to receive an indication of a selection of one of the first synthesized voice data or the second synthesized voice data by the user of voice interface system 200. In some embodiments, receiving unit 250 may receive the indication of the selection from a selection device 270. Selection device 270 may be configured to be placed close to the user of voice interface system 200 and to detect the user's selection of one of the first synthesized voice data or the second synthesized voice data. Although FIG. 2 illustrates sound device 260 and selection device 270 as discrete blocks, one skilled in the art will appreciate that both devices may be incorporated into a single piece of user equipment, such as a headset. In those embodiments, the user of voice interface system 200 may hear the first synthesized voice data with his/her right ear and the second synthesized voice data with his/her left ear, both of which may be provided by voice interface system 200. While hearing the first synthesized voice data and the second synthesized voice data, the user of voice interface system 200 may want to hear additional information relating to one of the first synthesized voice data or the second synthesized voice data. If the user wants to hear additional data relating to the first synthesized voice data, he/she may show an indication of a selection of the first synthesized voice data. In such cases, selection device 270 may detect the indication of the selection and provide it to receiving unit 250 of voice interface system 200. In response to receiving the indication of the selection, voice interface system 200 may further provide additional data corresponding to the selected first synthesized voice data to the user of voice interface system 200.

FIG. 3(A) schematically shows an illustrative example of a voice interface system configured to provide two voice data substantially simultaneously to a user in accordance with at least some embodiments described herein. As depicted in FIG. 3(A), a voice interface system 300 may receive a first text data 310 and a second text data 320 and convert at least a part of first text data 310 and at least a part of second text data 320 into a first synthesized voice data 330 and a second synthesized voice data 340, respectively. The receiving and converting processes and the components of voice interface system 300 may be similar to those described with reference to FIG. 2 above. Hereinafter, the description may be based, at least in part, on the assumption that first text data 310 may be an e-mail message and second text data 320 may be a web page of a news article. By way of example, but not limitation, first text data 310 may include sender information and e-mail contents, and second text data 320 may include a news title and news contents. In some embodiments, voice interface system 300 may convert the sender information of first text data 310 into first synthesized voice data 330 based, at least in part, on a first acoustic model stored in a database of voice interface system 300. Similarly, voice interface system 300 may convert the news title of second text data 320 into second synthesized voice data 340 based, at least in part, on a second acoustic model stored in the data base of voice interface system 300.

A user 350 of voice interface system 300 may wear a headset 360, and headset 360 may be operatively coupled to voice interface system 300. Headset 360 may comprise two sound speakers for both ears of user 350 and a sensor for detecting a user selection. By way of example, but not limitation, the sensor may include a gyro sensor. Further, headset 360 may be configured to receive first synthesized voice data 330 and second synthesized voice data 340 and present them to user 350 of voice interface system 300. User 350 may hear first synthesized voice data 330 from the right side and second synthesized voice data 340 from the left side at the same time. As discussed with reference FIG. 2 above, since the feature difference between first synthesized voice data 330 and second synthesized voice data 340 is maximized, even though both of first synthesized voice data 330 and second synthesized voice data 340 are substantially simultaneously presented to user 350, user 350 may be able to readily distinguish first synthesized voice data 330 and second synthesized voice data 340.

During or after hearing first synthesized voice data 330 and second synthesized voice data 340 (both of which may include a part of respective original text data, i.e., the sender information and the news title), user 350 of voice interface system 300 may want to hear more information relating to one of first synthesized voice data 330 or second synthesized voice data 340. As depicted in FIG. 3(A), if user 350 wants to hear additional data relating first synthesized voice data 330 (i.e., the e-mail contents), user may show an indication of a selection of first synthesized voice data 330 by leaning the head to the direction where first synthesized voice data 330 is heard (i.e., the right of the head). In such cases, the gyro sensor of headset 360 may detect the indication of the selection (i.e., the leaning of the head to the right) and provide indication to voice interface system 300.

FIG. 3(B) schematically shows an illustrative example of a voice interface system configured to provide additional data in response to a user selection in accordance with at least some embodiments described herein. As illustrated in FIG. 3(B), in response to receiving the indication of the selection of first synthesized voice data 330, voice interface system 300 may provide additional data corresponding to first synthesized voice data 330 (i.e., the e-mail contents) to user 350 of voice interface system 300.

Figure 4:
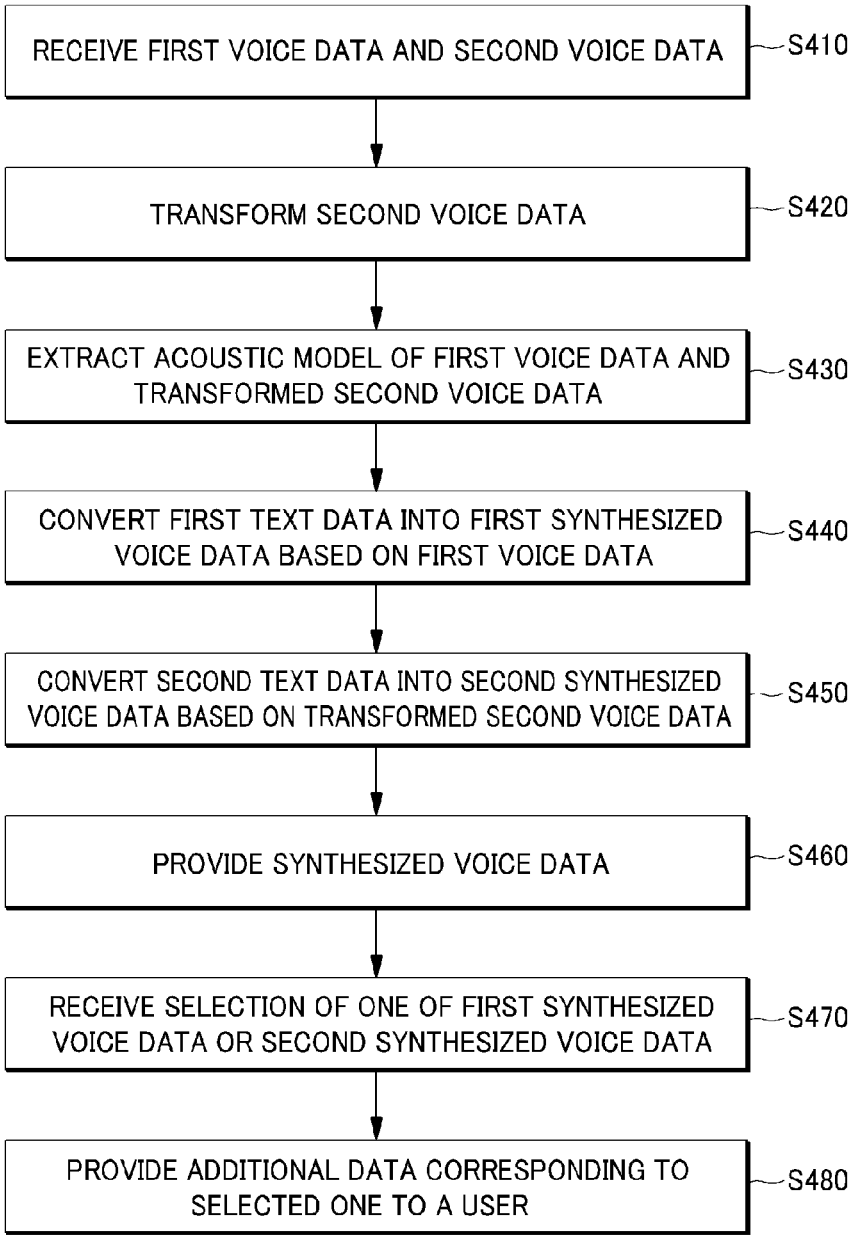
FIG. 4 shows an example flow diagram of a process for providing synthesized voice data.

FIG. 4 shows an example flow diagram of a process for providing synthesized voice data in accordance with at least some embodiments described herein. The method in FIG. 4 may be implemented using voice interface system 200 including voice processing unit 210, database 220, converting unit 230, play-back unit 240 and receiving unit 250 discussed above. An example process may include one or more operations, actions, or functions as illustrated by one or more of blocks S410, S420, S430, S440, S450, S460, S470 and/or S480. Although illustrated as discrete blocks, various blocks may be divided into additional blocks, combined into fewer blocks, or eliminated, and accordingly, is not limited in these respects. Processing may begin at block S410.

At block S410, the voice interface system may receive a first voice data from a first narrator and a second voice data from a second narrator. In some embodiments, the first narrator and the second narrator may have difference voice features in order that, in the following process, the second voice data of the second narrator may be transformed to have a maximized feature difference between the first voice data of the first narrator and the second voice data of the second narrator. By way of example, the first narrator may be a man (i.e., masculine type voice) and the second narrator a woman (i.e., feminine type voice). Processing may continue from block S410 to block S420.

At block S420, the voice interface system may transform the second voice data by a voice transformation function. The voice transformation function may maximize a feature difference between the first voice data and the transformed second voice data so that the first voice data and the transformed second voice data may be clearly distinguished from each other. In some embodiments, the voice transformation function may be determined using a voice processing module including voice processing unit 210 discussed above. Processing may continue from block S420 to block S430.

At block S430, the voice interface system may extract at least one acoustic model of the first voice data and at least one acoustic model of the transformed second voice data. In some embodiments, the acoustic models may be stored in a database of the voice interface system and used for converting text data into synthesized voice data. Processing may continue from block S430 to block S440.

At block S440, the voice interface system may convert at least a part of a first text data into a first synthesized voice data based, at least in part, on the first voice data. In some embodiments, the voice interface system may convert the at least a part of the first text data into the first synthesized voice data using the at least one acoustic model of the first voice data. Processing may continue from block S440 to block S450.

At block S450, the voice interface system may convert at least a part of a second text data into a second synthesized voice data based on the transformed second voice data. In some embodiments, the voice interface system may convert the at least a part of the second text data into the second synthesized voice data using the at least one acoustic model of the transformed second voice data. Since the feature difference between the first voice data and the transformed second voice data may have been maximized by the voice transformation function as discussed above, the first synthesized voice data and the second synthesized voice data can be readily distinguished from each other even when presented substantially simultaneously. Processing may continue from block S450 to block S460.

At block S460, the voice interface system may provide the first synthesized voice data and the second synthesized voice data to a user of the voice interface system. In some embodiments, the voice interface system may provide the first synthesized voice data and the second synthesized voice data in parallel on a temporal axis (i.e., substantially simultaneously). As discussed above, the user may easily distinguish the first synthesized voice data and the second synthesized voice data even when the two are presented at the same time. Processing may continue from block S460 to S470.

At block S470, the voice interface system may receive an indication of a selection of one of the first synthesized voice data or the second synthesized voice data by the user of the voice interface system. Processing may continue from block S470 to S480.

At block S480, the voice interface system may provide additional data corresponding to the selected one to the user of the voice interface system. In some embodiments, the additional data may be synthesized voice data. In some embodiments, the first and second synthesized voice data may include some information of the original text data, and the additional data may include other information of the original text data. By way of example, but not limitation, the first text data may be an e-mail message including sender information and e-mail contents. In such cases, the first synthesized voice data may include information about the sender information only, and the additional data may include information about the e-mail contents.

Figure 5:
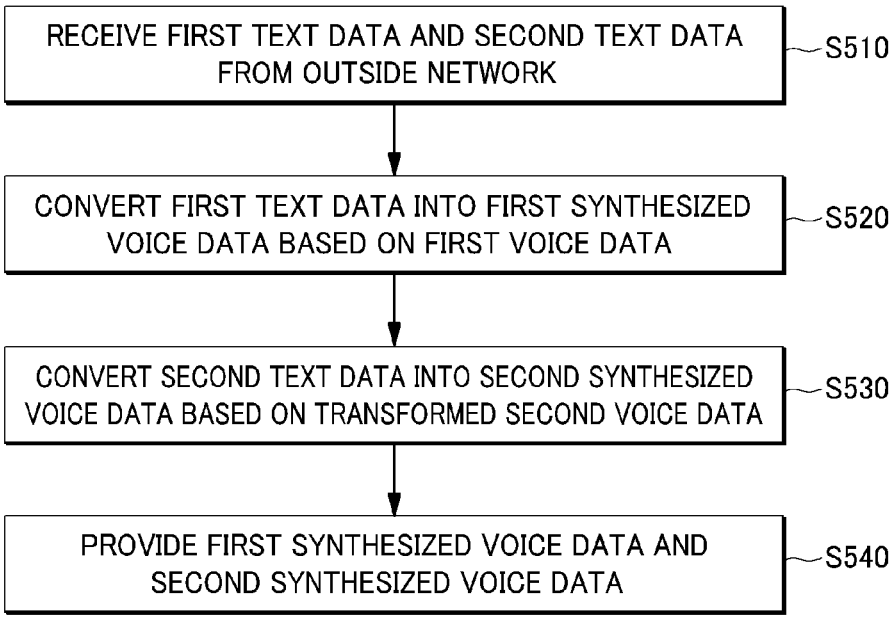
FIG. 5 shows another example flow diagram of a process for providing synthesized voice data.

FIG. 5 shows another example flow diagram of a process for providing synthesized voice data in accordance with at least some embodiments described herein. The method in FIG. 5 may be implemented using voice interface system 200 including voice processing unit 210, database 220, converting unit 230, play-back unit 240 and receiving unit 250 discussed above. An example process may include one or more operations, actions, or functions as illustrated by one or more of blocks S510, S520, S530 and/or S540. Although illustrated as discrete blocks, various blocks may be divided into additional blocks, combined into fewer blocks, or eliminated, depending on the desired implementation. Processing may begin at block S510.

At block S510, the voice interface system may receive a first text data and a second text data from an outside network. By way of example, but not limitation, the first text data and/or the second text data may be an e-mail message from an e-mail server, a web page from a web server or an SNS message from an SNS server. Processing may continue from block S510 to S520.

At block S520, the voice interface system may convert at least a part of the first text data into a first synthesized voice data based on a first voice data. In some embodiments, the voice interface system may convert the at least a part of the first text data into the first synthesized voice data using at least one acoustic model of the first voice data stored in a database of the voice interface system. Processing may continue from block S520 to S530.

At block S530, the voice interface system may convert at least a part of the second text data into a second synthesized voice data based on a transformed second voice data that is transformed from a second voice data by a voice transformation function. The voice transformation function maximizes a feature difference between the first voice data and the transformed second voice data so that the first voice data and the transformed second voice data are clearly distinguished with each other. In some embodiments, the voice interface system may convert the at least a part of the second text data into the second synthesized voice data using at least one acoustic model of the transformed second voice data stored in the database of the voice interface system. Processing may continue from block S530 to block S540.

At block S540, the voice interface system may provide the first synthesized voice data and the second synthesized voice data. In some embodiments, the voice interface system may provide the first synthesized voice data and the second synthesized voice data in parallel on a temporal axis (i.e., substantially simultaneously). Since the feature difference between the first voice data and the transformed second voice data may have been maximized by the voice transformation function as discussed above, the first synthesized voice data and the second synthesized voice data can be readily distinguished from each other even when those are presented substantially simultaneously.

One skilled in the art will appreciate that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

Figure 6:
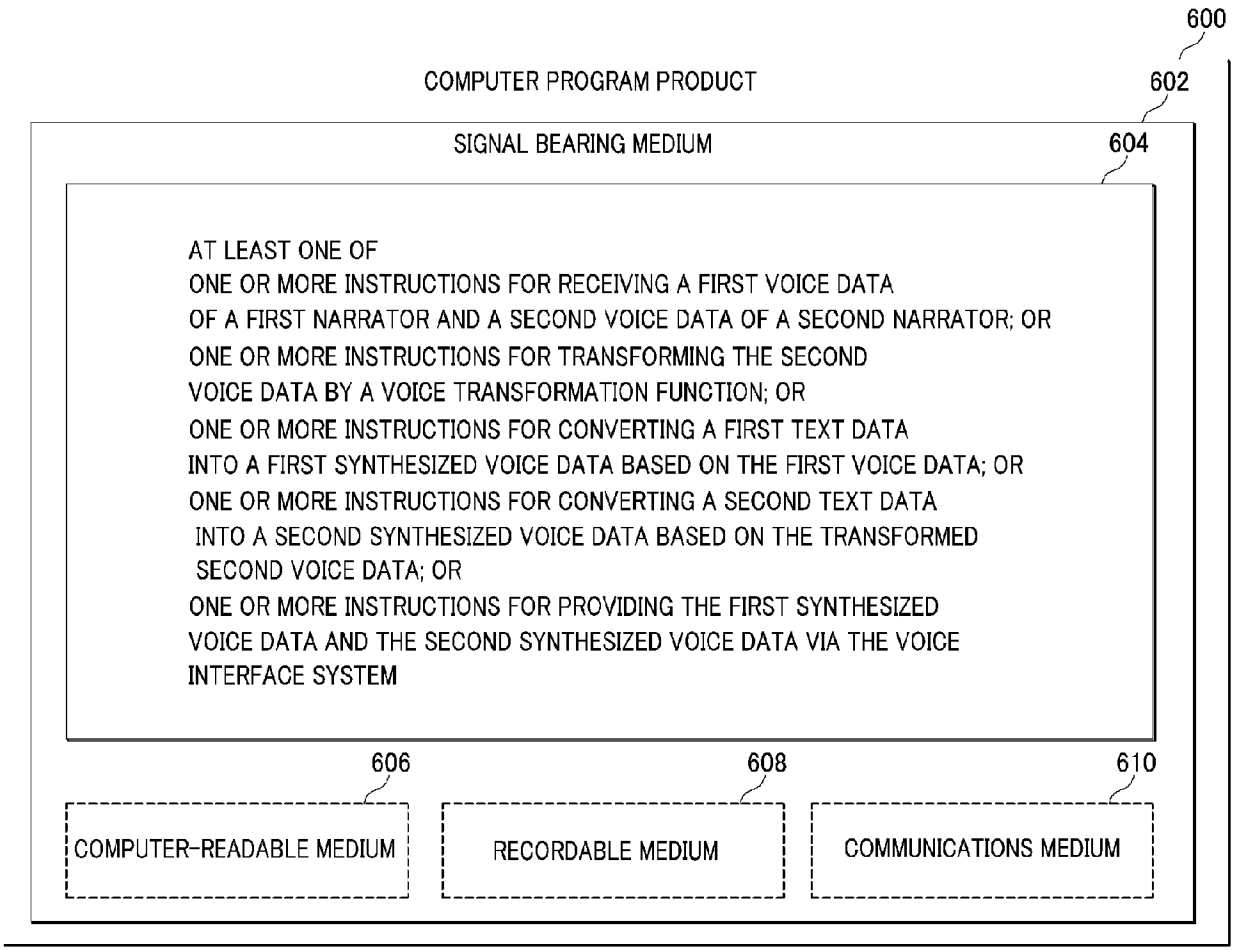
FIG. 6 illustrates computer program products that can be utilized to provide a voice processing scheme for a voice interface system.

FIG. 6 illustrates computer program products 600 that may be utilized to provide voice interface in accordance with at least some embodiments described herein. Program product 600 may include a signal bearing medium 602. Signal bearing medium 602 may include one or more instructions 604 that, when executed by, for example, a processor, may provide the functionality described above with respect to FIGS. 1-5. By way of example, instructions 604 may include one or more instructions for receiving a first voice data of a first narrator and a second voice data of a second narrator, one or more instructions for transforming the second voice data by a voice transformation function, one or more instructions for converting at least a part of a first text data into a first synthesized voice data based on the first voice data, one or more instructions for converting at least a part of a second text data into a second synthesized voice data based on the transformed second voice data, and one or more instructions for providing the first synthesized voice data and the second synthesized voice data via the voice interface system. Thus, for example, referring to the system of FIG. 2, voice interface system 200 may undertake one or more of the blocks shown in FIG. 4 in response to instructions 604.

In some implementations, signal bearing medium 602 may encompass a computer-readable medium 606, such as, but not limited to, a hard disk drive (HDD), a Compact Disc (CD), a Digital Video Disk (DVD), a digital tape, memory, etc. In some implementations, signal bearing medium 602 may encompass a recordable medium 608, such as, but not limited to, memory, read/write (R/W) CDs, R/W DVDs, etc. In some implementations, signal bearing medium 602 may encompass a communications medium 610, such as, but not limited to, a digital and/or an analog communication medium (e.g., a fiber optic cable, a waveguide, a wired communication link, a wireless communication link, etc.). Thus, for example, computer program product 600 may be conveyed to one or more modules of voice interface system 200 by an RF signal bearing medium 602, where the signal bearing medium 602 is conveyed by a wireless communications medium 610 (e.g., a wireless communications medium conforming with the IEEE 802.11 standard).

Figure 7:
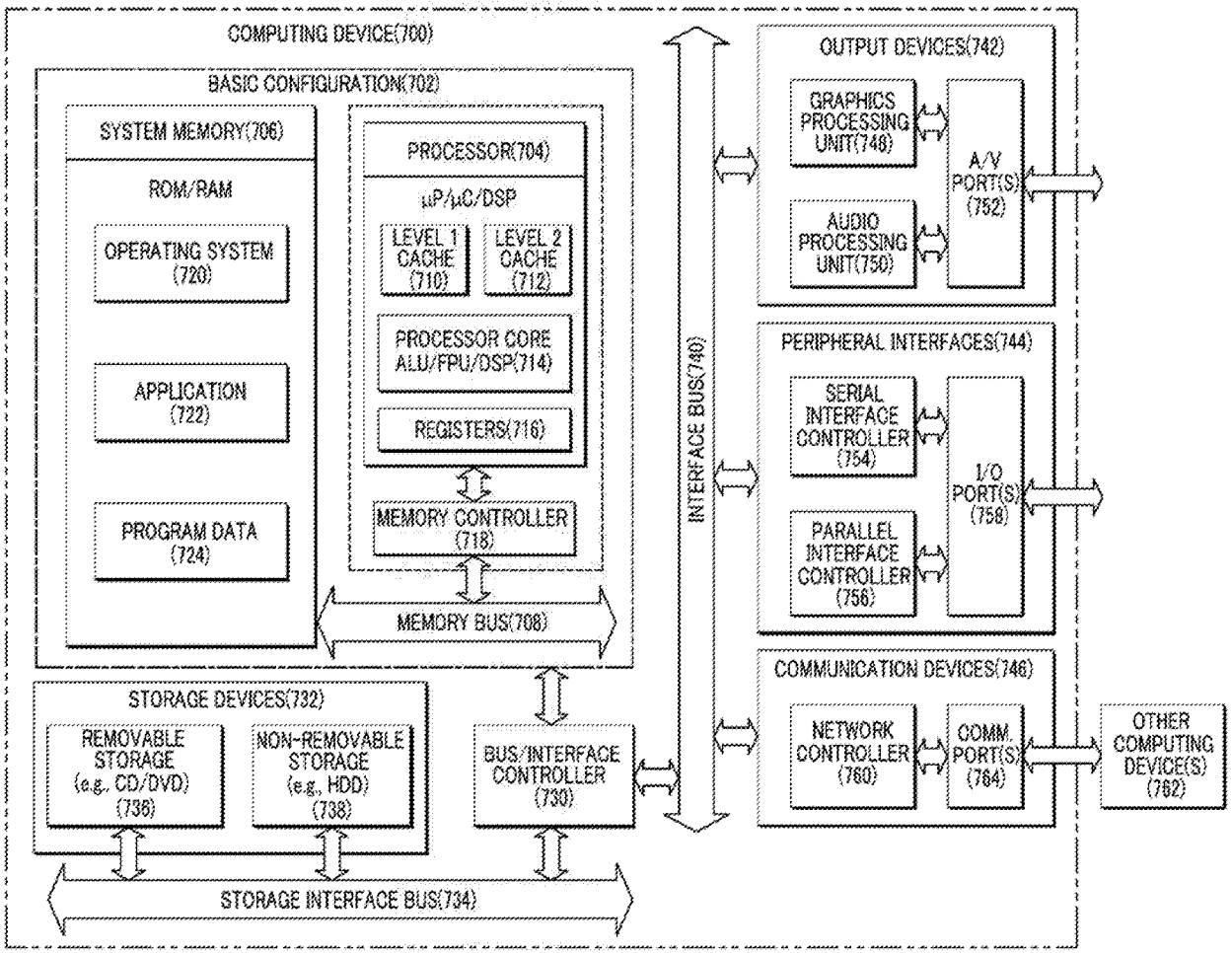
FIG. 7 is a block diagram illustrating an example computing device that can be utilized to provide a voice processing scheme for a voice interface system.

FIG. 7 is a block diagram illustrating an example computing device 700 that can be utilized to provide voice interface in accordance with at least some embodiments described herein. In a very basic configuration 702, computing device 700 may typically include one or more processors 704 and a system memory 706. A memory bus 708 may be used for communicating between processor 704 and system memory 706.

Depending on the desired configuration, processor 704 may be of any type including but not limited to a microprocessor (μP), a microcontroller (μC), a digital signal processor (DSP), or any combination thereof. Processor 704 may include one or more levels of caching, such as a level one cache 710 and a level two cache 712, a processor core 714, and registers 716. An example processor core 714 may include an arithmetic logic unit (ALU), a floating point unit (FPU), a digital signal processing core (DSP Core), or any combination thereof. An example memory controller 718 may also be used with processor 704, or in some implementations memory controller 718 may be an internal part of processor 704.

Depending on the desired configuration, system memory 706 may be of any type including but not limited to volatile memory (such as RAM), non-volatile memory (such as ROM, flash memory, etc.) or any combination thereof. System memory 706 may include an operating system 720, one or more applications 722, and program data 724.

In some embodiments, application 722 may be arranged to operate with program data 724 on operating system 720 such that voice interface may be provided. This described basic configuration 702 is illustrated in FIG. 7 by those components within the inner dashed line.

Computing device 700 may have additional features or functionality, and additional interfaces to facilitate communications between basic configuration 702 and any required devices and interfaces. For example, a bus/interface controller 730 may be used to facilitate communications between basic configuration 702 and one or more data storage devices 732 via a storage interface bus 734. Data storage devices 732 may be removable storage devices 736, non-removable storage devices 738, or a combination thereof. Examples of removable storage and non-removable storage devices include magnetic disk devices such as flexible disk drives and hard-disk drives (HDD), optical disk drives such as compact disk (CD) drives or digital versatile disk (DVD) drives, solid state drives (SSD), and tape drives to name a few. Example computer storage media may include volatile and non-volatile, removable and non-removable media implemented in any method or technology for storage of information, such as computer readable instructions, data structures, program modules, or other data.

System memory 706, removable storage devices 736 and non-removable storage devices 738 are examples of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which may be used to store the desired information and which may be accessed by computing device 700. Any such computer storage media may be part of computing device 700.

Computing device 700 may also include an interface bus 740 for facilitating communication from various interface devices (e.g., output devices 742, peripheral interfaces 744, and communication devices 746) to basic configuration 702 via bus/interface controller 730. Example output devices 742 include a graphics processing unit 748 and an audio processing unit 750, which may be configured to communicate to various external devices such as a display or speakers via one or more A/V ports 752. Example peripheral interfaces 744 include a serial interface controller 754 or a parallel interface controller 756, which may be configured to communicate with external devices such as input devices (e.g., keyboard, mouse, pen, voice input device, touch input device, etc.) or other peripheral devices (e.g., printer, scanner, etc.) via one or more I/O ports 758. An example communication device 746 includes a network controller 760, which may be arranged to facilitate communications with one or more other computing devices 762 over a network communication link via one or more communication ports 764.

The network communication link may be one example of a communication media. Communication media may typically be embodied by computer readable instructions, data structures, program modules, or other data in a modulated data signal, such as a carrier wave or other transport mechanism, and may include any information delivery media. A "modulated data signal" may be a signal that has one or more of its characteristics set or changed in such a manner as to encode information in the signal. By way of example, and not limitation, communication media may include wired media such as a wired network or direct-wired connection, and wireless media such as acoustic, radio frequency (RF), microwave, infrared (IR) and other wireless media. The term computer readable media as used herein may include both storage media and communication media.

Computing device 700 may be implemented as a portion of a small-form factor portable (or mobile) electronic device such as a cell phone, a personal data assistant (PDA), a personal media player device, a wireless web-watch device, a personal headset device, an application specific device, or a hybrid device that include any of the above functions. Computing device 700 may also be implemented as a personal computer including both laptop computer and non-laptop computer configurations.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation, no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general, such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A method comprising:

receiving, by a device comprising a processor, first voice data associated with a first narrator identity and second voice data associated with a second narrator identity;

generating, by the device, transformed second voice data, wherein the generating comprises transforming the second voice data as a function of a power spectrum difference between the first voice data and the second voice data;

receiving, by the device, first text data and second text data;

converting, by the device, at least a part of the first text data into first synthesized voice data based, at least in part, on the first voice data;

converting, by the device, at least a part of the second text data into second synthesized voice data based, at least in part, on the transformed second voice data;

rendering, by the device, the first synthesized voice data via a first speaker and the second synthesized voice data via a second speaker, wherein the first synthesized voice data and the second synthesized voice data are presented concurrently;

receiving an input, by the device via an input device, that enables a selection of the first synthesized voice data or the second synthesized voice data presented concurrently, resulting in selected synthesized voice data; and presenting, by the device via at least one of the first speaker or the second speaker, additional content related to an aspect of content currently being communicated via the selected synthesized voice data.

2. The method of claim 1, further comprising:

extracting, by the device, at least one acoustic model of the first voice data and at least one acoustic model of the transformed second voice data, wherein the converting of at least the part of the first text data is based on the at least one acoustic model of the first voice data, and wherein the converting of at least the part of the second text data is based on the at least one acoustic model of the transformed second voice data.

3. The method of claim 1, wherein the selection of the first synthesized voice data or the second synthesized voice data comprises receiving the input to the device that specifies a movement of the input device in a direction of the first synthesized voice data or in a direction of second synthesized voice data, respectively.

4. The method of claim 3, wherein the additional content is synthesized voice data.

5. The method of claim 1, further comprising:

detecting, by the device via a sensor of a voice interface of the device, a gesture that corresponds to an input received by the voice interface; and determining, by the device, whether the gesture corresponds to a selection of the first synthesized voice data or the second synthesized voice data.

6. The method of claim 5, wherein the first speaker and the second speaker are on a headset, and wherein the sensor comprises a gyro sensor in the headset to detect whether the headset is leaning in the direction of the first speaker or the second speaker.

7. The method of claim 1, wherein at least one of the first text data and the second text data is received from a network device of a network.

8. The method of claim 7, wherein at least one of the first text data or the second text data is selected from at least one of an e-mail message, a web page, or a text message.

9. A method comprising:

receiving, by a device comprising a processor, first text data and second text data;

converting, by the device, at least a part of the first text data into first synthesized voice data based, at least in part, on first voice data;

converting, by the device, at least a part of the second text data into second synthesized voice data based, at least in part, on transformed second voice data that is transformed from second voice data by a voice transformation function, wherein the voice transformation function relates to a power spectrum difference between the first voice data and the transformed second voice data;

sending, by the device, the first synthesized voice data to a first speaker to render the first synthesized voice data and the second synthesized voice data to a second speaker to render the second synthesized voice data, wherein the first synthesized voice data and the second synthesized voice data are to be rendered substantially simultaneously, and wherein the voice transformation function facilitates distinguishing the first voice data from the second voice data as distinct data sources; and in response to receiving, by the device, via an input device, an indication that corresponds to a selection of the first synthesized voice data or a selection of the second synthesized voice data, causing, the device to generate sound, via at least one of the first speaker or the second speaker, that represents additional data corresponding to the first synthesized voice data or the second synthesized voice data based on the indication.

10. The method of claim 9, wherein the converting the at least the part of the first text data is based on at least one acoustic model of the first voice data, and wherein the converting the at least the part of the second text data is based on at least one acoustic model of the transformed second voice data.

11. The method of claim 9, wherein the receiving the indication comprises receiving a movement of the input device in a direction of the first speaker or the second speaker.

12. The method of claim 9, wherein the additional data is synthesized voice data.

13. The method of claim 9, further comprising:

detecting, by the device via a sensor of the input device, a gesture; and determining whether the gesture corresponds to a selection of the first synthesized voice data or the second synthesized voice data.

14. The method of claim 9, wherein the first speaker and the second speaker are on a headset, and wherein the sensor comprises a gyro sensor in the headset to detect a headset tilt gesture substantially in the direction of the first speaker or the second speaker.

15. A system, comprising:

a storage device that stores at least one acoustic model of first voice data and at least one acoustic model of transformed second voice data that is transformed from second voice data by a voice transformation function;

a converting device that converts at least a part of first text data into first synthesized voice data based, at least in part, on the at least one acoustic model of the first voice data and converts at least a part of second text data into a second synthesized voice data based, at least in part, on the at least one acoustic model of the transformed second voice data as a function of a power spectrum difference between the first voice data and the transformed second voice data;

a play-back device that plays the first synthesized voice data via a first speaker and the second synthesized voice data via a second speaker, wherein the first synthesized voice data and the second synthesized voice data are presented substantially simultaneously, and wherein the conversion facilitates distinction of the first voice data from the second voice data; and an interface configured to receive an indication that corresponds to a selection of the first synthesized voice data or a selection of the second synthesized voice data, wherein the play-back device is further configured to generate sounds that represent additional data corresponding to the first synthesized voice data or the second synthesized voice data based on the received indication via the interface.

16. The system of claim 15, wherein the interface is a headset comprising the first speaker, the second speaker, and a gyro sensor that facilitates detection of a degree of tilt of the headset as the indication.

17. The system of claim 15, wherein the interface is a headset comprising the first speaker, the second speaker, and a gyro sensor that facilitates detection of a leaning motion of the headset as the indication.

18. A non-transitory computer-readable storage medium comprising executable instructions that, in response to execution by a system comprising a processor, facilitate performance of operations, comprising:

obtaining first voice data of a first narrator and second voice data of a second narrator;

transforming the second voice data into transformed second voice data as a function of a power spectrum difference between the first voice data and the second voice data;

obtaining first text data and second text data;

converting at least a part of the first text data into first synthesized voice data based, at least in part, on the first voice data;

converting at least a part of the second text data into second synthesized voice data based, at least in part, on the transformed second voice data;

rendering the first synthesized voice data via a first speaker and the second synthesized voice data via a second speaker, wherein the first synthesized voice data and the second synthesized voice data are presented concurrently, and wherein the transforming the second voice data into the transformed second voice data facilitates distinction of the first synthesized voice data from the second synthesized voice data; and in response to obtaining a motion of an input device that represents an indication which corresponds to a selection of the first synthesized voice data or a selection of the second synthesized voice data, providing supplemental data, to at least one of the first speaker or the second speaker, that corresponds to the first synthesized voice data or the second synthesized voice data based on the indication.

19. The non-transitory computer-readable storage medium of claim 18, wherein the obtaining the motion of the input device includes obtaining via a gyro-sensor enabled headset device.

20. A non-transitory computer-readable storage medium comprising executable instructions that, in response to execution by a system comprising a processor, cause the system to perform or facilitate performance of operations, comprising:

obtaining first text data and second text data;

converting at least a part of the first text data into first synthesized voice data based, at least in part, on first voice data;

converting at least a part of the second text data into second synthesized voice data based, at least in part, on transformed second voice data that is transformed from second voice data as a function of a power spectrum difference between the first voice data and the second voice data;

sending the first synthesized voice data via a first speaker of a headset device and the second synthesized voice data via a second speaker of the headset device, wherein the first synthesized voice data and the second synthesized voice data are presented substantially simultaneously; and in response to obtaining a motion input, via the headset device, that represents an indication which corresponds to a selection of the first synthesized voice data or a selection of the second synthesized voice data, sending to the headset device, supplemental data that corresponds to the first synthesized voice data or the second synthesized voice data correspondingly.

21. The non-transitory computer-readable storage medium of claim 20, wherein the headset device comprises a gyro sensor to enable detection of the motion input that represents the indication.

* * * * *